United States Patent [19]

Hanagata

[11] Patent Number: 4,862,679

[45] Date of Patent: Sep. 5, 1989

[54] PACKAGING APPARATUS FOR PACKAGING ARTICLES IN A DOUBLE FILM

[75] Inventor: Toshiyuki Hanagata, Toyama, Japan

[73] Assignee: Kabushiki Kaisha Hanagata, Toyama, Japan

[21] Appl. No.: 255,652

[22] Filed: Oct. 7, 1988

[30] Foreign Application Priority Data

Aug. 11, 1988 [JP] Japan ..... 200747

[51] Int. Cl.[4] ..... B65B 9/06

[52] U.S. Cl. ..... 53/568; 198/343; 198/345

[58] Field of Search ..... 53/373, 550, 568; 198/343, 345, 460, 461, 812

[56] References Cited

U.S. PATENT DOCUMENTS 3,618,740 11/1971 Tavern ..... 53/553 X 4,219,988 9/1980 Shanklin et al. ..... 53/568 X 4,313,288 2/1982 Tassi et al. ..... 53/74

4,553,377 11/1985 Klinkel ..... 53/550 X

*Primary Examiner*—Robert L. Spruill

*Assistant Examiner*—Linda B. Johnson

*Attorney, Agent, or Firm*—Flynn, Thiel, Boutell & Tanis

[57] ABSTRACT

A packaging apparatus for packaging articles in a double film enables to seal and package the articles by a double film without stopping operation of the belt conveyor. The packaging apparatus comprises a base, a movable table reciprocatory moving in the longitudinal direction thereof, a feeding unit mounted on the movable table for feeding the double film, a feeding belt conveyor provided over the movable table for feeding the article to the double film, a sealing unit mounted on the movable table for sealing the article, and a discharging belt conveyor provided over the movable table for feeding the article to the sealing unit and discharging the packaged articles from the discharging belt conveyor.

4 Claims, 3 Drawing Sheets

PACKAGING APPARATUS FOR PACKAGING ARTICLES IN A DOUBLE FILM

BACKGROUND OF THE INVENTION

1. Field of the Invention

The present invention relates to a packaging apparatus for packaging articles in a double film which enables to arbitrarily package articles without stopping a flow of feeding of the articles to be packaged irrespective of the intervals between the articles and the lengths of the articles while the articles are sealed by the double film extended from a roll of film.

2. Prior Art

A prior packaging apparatus of this kind is generally provided with a feeding unit and a sealing unit disposed after the feeding unit. Articles carried on a feeding belt conveyor provided at the feeding unit are fed to a discharging belt conveyor provided at the side of the sealing unit while they are inserted into a film, then the sealing unit is actuated to permit the article to be sealed in the film. During the operation just mentioned above, the feeding belt conveyor is always travelling or stopped when required. However, the discharging conveyor is always intermittently travelling since the articles shall be stopped when they are sealed.

As described above, packaging capacity is influenced seriously by sealing capacity or time involved in sealing the articles. In the prior packaging apparatus, there is a problem that a flow of feeding of the articles are stopped at the sealing unit whereby the packaging capacity is decreased accordingly. There is another problem that tall articles, collected articles, unstable articles are likely to be fallen down or collapsed by inertia thereof caused by stopping of the discharging belt conveyor.

SUMMARY OF THE INVENTION

It is therefore an object of the present invention to provides a packaging apparatus for packaging articles in a double film enabling to seal the article without stopping a flow of feeding of the article to be packaged.

It is another object of the present invention to provide a packaging apparatus for packaging articles in a double film capable of improving the packaging capacity.

It is still another object of the present invention to provide a packaging apparatus for packaging articles in a double film capable of preventing the articles from being fallen down or collapsed by inertia or shock caused by the stop of the belt conveyor.

To achieve the above object, the present invention provide a packaging apparatus for packaging articles in a double film comprising: a base having on the upper central portion thereof a pair of rails; a movable table reciprocatory movable on the rails and composed of a base frame fixed on the base, a feeding frame mounted on the rear portion of the base frame, and a sealing frame mounted on the front portion of the base frame; a feeding belt conveyor comprising a drive roller supported by a supporting member fixed on the reaar end of the base, a driven roller fixedly mounted on the front portion of the feeding frame, a first double winding roller supported by a supporting member fixedly mounted on the portion close to the rear end of the base, a second double winding roller mounted fixedly on the rear portion of the feeding frame, and a feeding belt trained and capable of travelling around the drive roller, the driven roller, the first double winding roller, the second double winding roller for feeding the article carried thereon to the film; a feeding unit disposed on the feeding frame and composed on a film feeding unit and a film opening unit; the film feeding unit having a roll of film therein; the film opening unit having an upper plate and a lower plate having respectively triangle shape and entrance for receiving the article therethrough formed obliquely with respect to the feeding belt conveyor so as to open in a direction opposite to the film feeding unit; a discharging belt conveyor comprising a drive roller supported by a supporting member fixed on the front end of the base, a driven roller fixedly mounted on the rear portion of the sealing frame, a first double winding roller supported by a supporting member fixedly mounted on the front portion of the base, a second double winding roller mounted fixedly on the front portion of the discharging frame, and a discharging belt trained and capable of travelling around the drive roller, the driven roller, the first double winding roller, the second double winding roller for feeding the article to the sealing unit, and discharging the packaged articles from the discharging belt conveyor; the driven roller of the discharging belt conveyor being spaced in a predetermined interval from the driven roller of the feeding conveyor belt; and a sealing unit disposed on the sealing frame and composed of an L-shaped sealer and a supporting base pivotally connected to the L-shaped sealer, the sealing unit openably closing for welding the film containing the articles, characterized in that the travelling speed of the discharging belt being substantially same as the moving speed of the movable table; lengths of the feeding belt conveyor and the discharging belt conveyor being varied by the movement of the movable table and the variation of the lengths being absorbed by variations of intervals between the double winding rollers.

The above and other objects, features and advantages of the present invention will become more apparent from the following description taken in conjunction with the accompanying drawings.

DESCRIPTION OF THE PREFERRED EMBODIMENT

Figure 1:
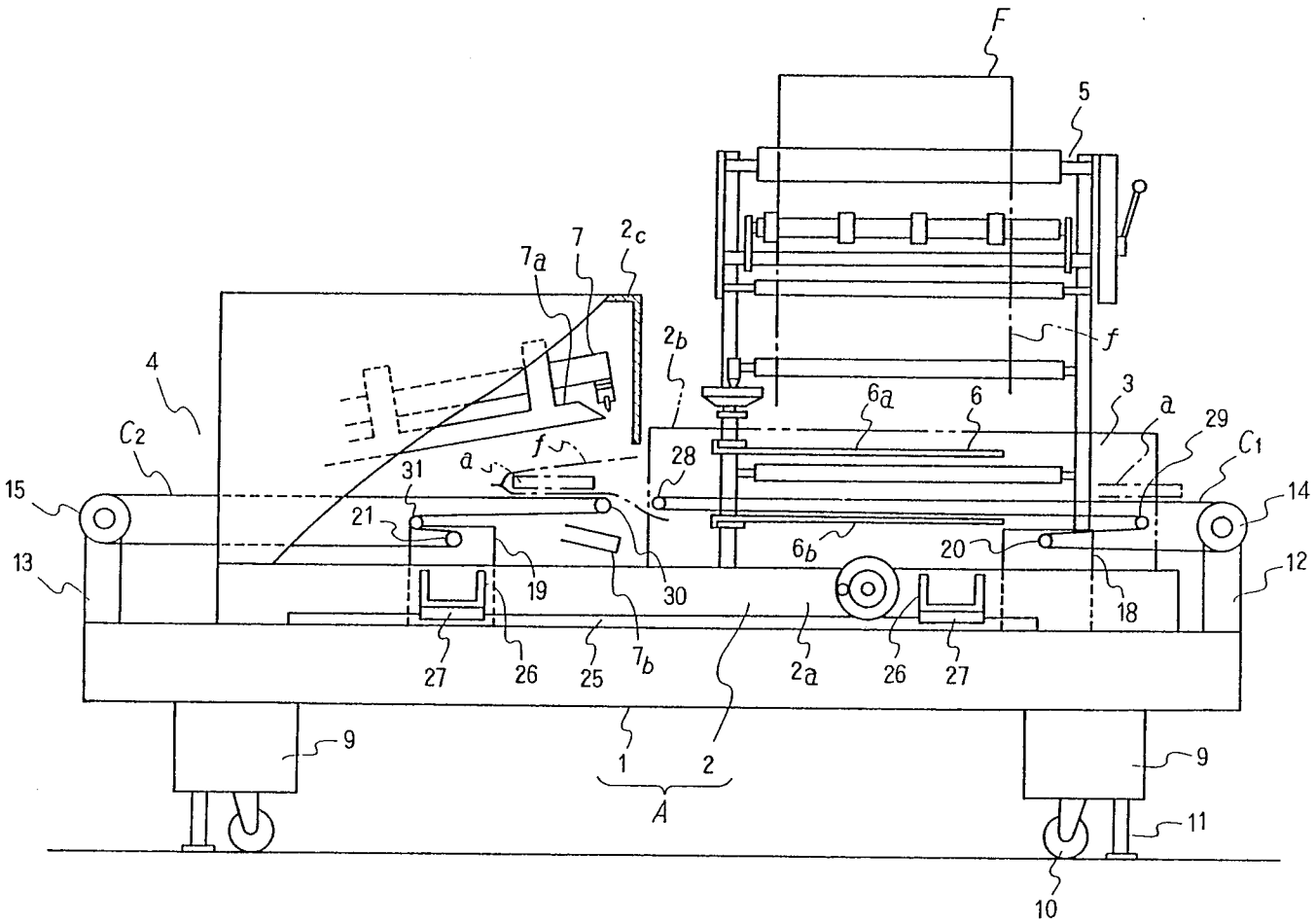
FIG. 1 is a front elevational view partly cut away a packaging apparatus for packaging articles, according to an embodiment of the present invention, in a state right before the article is sealed.
Figure 2:
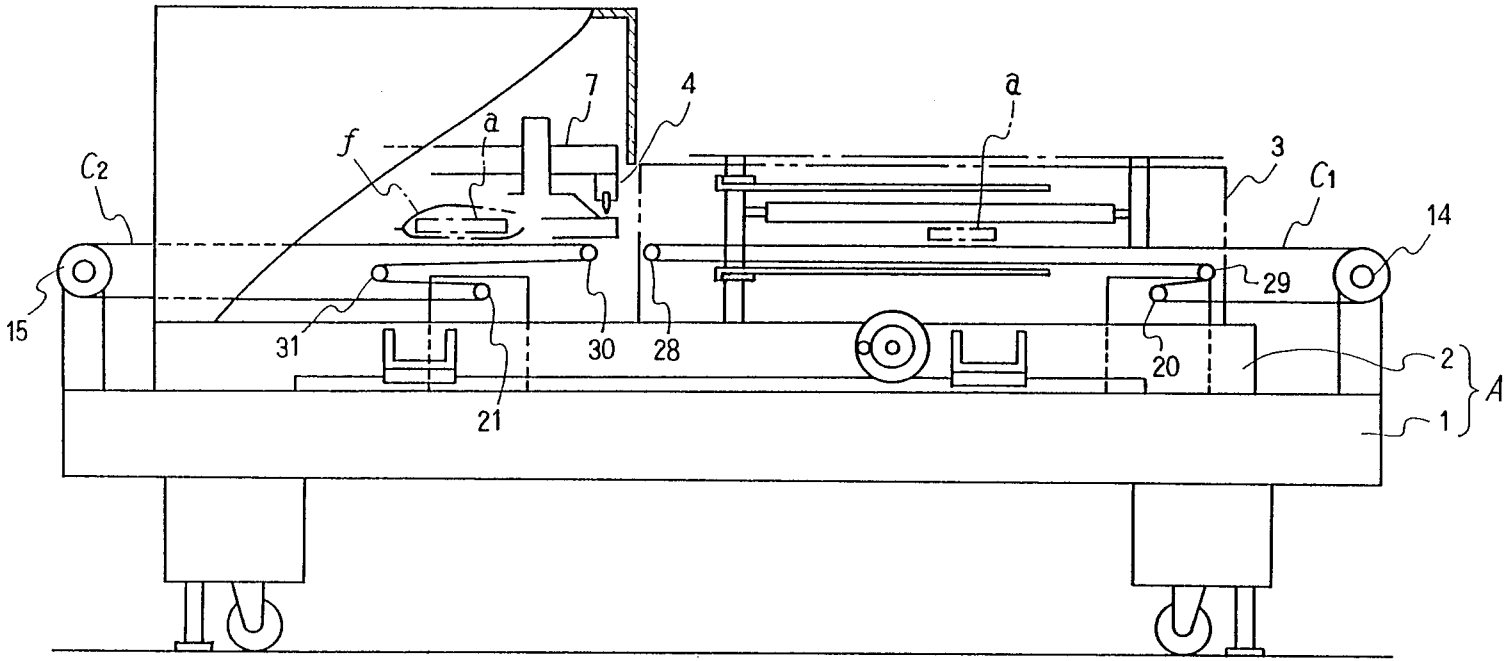
FIG. 2 is a front elevational view of a packaging apparatus for packaging articles of FIG. 1.
Figure 3:
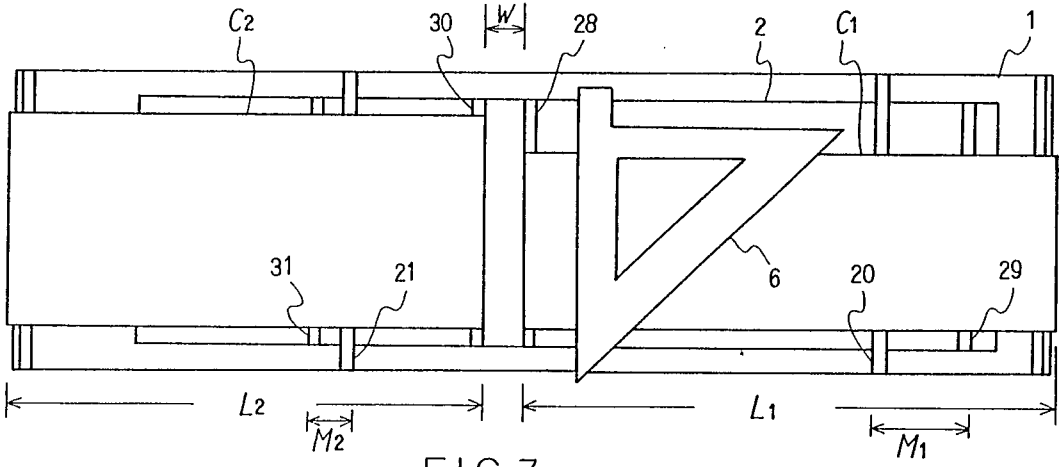
FIG. 3 is a plan view for assistance of explanation of the status in FIG. 1.
Figure 4:
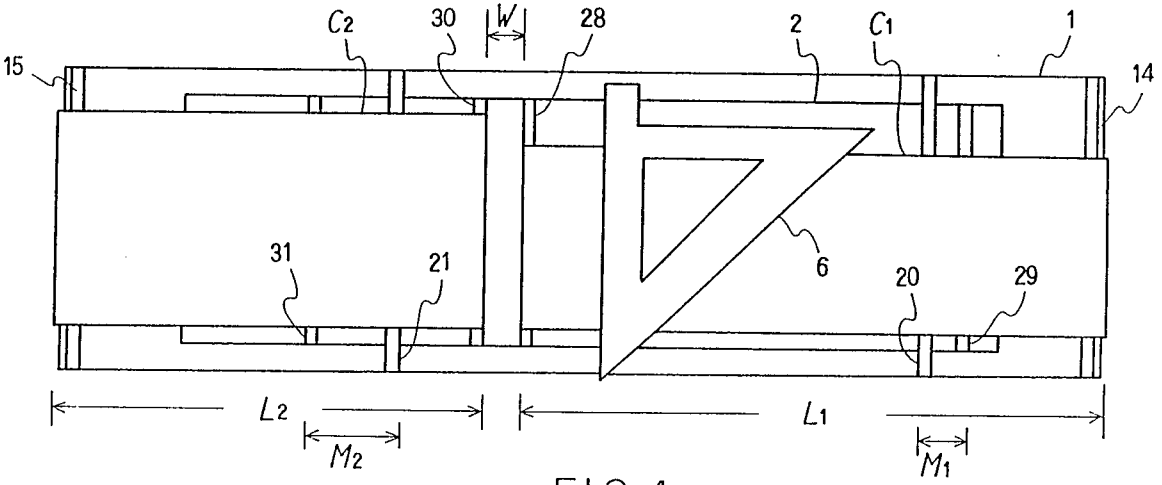
FIG. 4 is a plan view for assistance of explanation of the status in FIG. 2.

The packaging apparatus for packaging the articles in a double film according to an embodiment of the present invention will be described in detail with reference to FIGS. 1 through 4.

The packaging apparatus for packaging the articles in a double film comprises a body A composed of a base 1 and a movable table 2, a feeding unit 3 disposed on the movable table 2 having a feeding belt conveyor C1, and a sealing unit 4 disposed on the movable table 2 aside the feeding unit 3 and having a discharging belt C2, a film opening unit 6 disposed over the feeding unit 3, a film feeding unit 5 disposed over the film opening unit 6, and a sealer 7 provided in the sealing unit 4 and disposed after the film opening unit 6. The sealer 7 employed in the present invention is so-called L-shaped type which can weld and seal the double film at two sides of the double film. The base 1 may have a pair of rails at the upper portion thereof.

The base 1 has at a lower end thereof movable wheels 10 and legs 9 provided with supporters 11 for fixedly supporting the packaging apparatus, a supporting member 12 projected upward from the upper rear end of the base 1 for supporting a drive roller 14 of the feeding belt conveyor C1, and a supporting member 13 projected upward from the upper front end of the base 1 for supporting a drive roller 15 of the discharging belt conveyor C2. The base 1 has further a supporting member 18 projected upward near the upper rear end of the base 1 for supporting a first double winding roller 20 for adjusting a length of the feeding belt conveyor C1 and a supporting member 19 projected upward near the upper front end of the base 1 for supporting a first double winding roller 21 for adjusting a length of the discharging belt conveyor C2.

The movable table 2 comprises a base frame **2*a* supported on the base 1, a feeding frame 2*b* mounted on the rear portion of the base frame 2*a*, and a sealing frame 2*c* mounted on the front portion of the base frame 2*a*. The base frame 2*a* may have at the both ends thereof a pair of brackets 26 on which sliding members 27 movable on rails 25 are fixedly mounted. Supported on the feeding frame 2*b*, a driven roller 28 and a second double winding roller 29 around which a feeding belt of the feeding belt conveyor C1 is trained. Supported on the sealing frame 2*c* a driven roller 30 and a second double winding roller 31 around which a discharging belt of the discharging belt conveyor C2 is trained. The movable table 2 is reciprocatory moved in the longitudinal direction thereof by an air cylinder (not shown). The feeding belt of the feeding belt conveyor C1 is trained around the drive roller 14 and the driven roller 28 and also trained around a pair of double winding rollers 20, 29. The discharging belt of the discharging belt conveyor C2 is trained around the drive roller 15 and the driven roller 30, also trained around a pair of double winding rollers 21, 31**.

The film feeding unit 5, the film opening unit 6, and the L-shaped sealer 7 are respectively mounted on the movable table 2 so as to move with the table 2 as a whole.

The film opening unit 6 comprises an upper plate **6*a* disposed above the feeding belt conveyor C1, and a lower plate 6*b* disposed directly below the upper plate 6*a* and under the feeding belt conveyor C1. The upper and lower plates 6*a*, 6*b* are respectively formed in triangle. An entrance for receiving articles a therethrough is formed obliquely with respect to the feeding belt conveyor C1 so as to open in a direction opposite to the film feeding unit 5. The double film f fed from a roll of film F in the film feeding unit 5 is opened inside out by the film opening unit 6 and drawn into the sealing unit 4**.

The sealer 7 in the sealing unit 4 composed of an L-shaped sealer **7*a* and a supporting base 7*b* supporting the L-shaped sealer 7*a*. The L-shaped sealer 7*a* is pivotally connected to the end of the supporting base 7*b* so that the sealer can effect an openable closing operation. The film f is welded by the sealer 7 at the two sides thereof when the sealer 7 is closed. At the sequential openable closing operation of the sealer 7**, the film f contained articles therein is successively welded at the three sides thereof, whereby the article is completely packaged in a state where the tip end of the film f is sealed by a method of welding and sealing articles at two sides of the film.

The packaging apparatus for packaging the article in a double film is operated as follow.

An article a carried on the belt conveyor C1 is inserted into the film f which is opened by the film opening unit 6, then fed to the discharging conveyor belt C2 so that the article a reaches to a tip end of the film f and contained therein. At this state, the sealer **7*a* is actuated to weld the film f whereby the article a is sealed by the film f and fed to a heat tunnel (not shown) by the discharging belt conveyor C2**.

Inasmuch as the discharging belt of the belt conveyor C2 is always travelled and the movable table 2 is moved toward the discharging belt conveyor C2 when the article a is sealed, and furthermore the moving speed of the movable table 2 and the travelling speed of the discharging belt of the discharging belt conveyor C2 are adjusted to become substantially same, the discharging belt conveyor C2 seems as if it were stopped when the article a is sealed. At this state, the article a on the discharging belt conveyor C2 when the article a is sealed is observed as if it were placed on the stopped discharging belt conveyor C2, and moved together with the sealer 7 and the movable table 2.

The article a when sealed is influenced by a static status, namely influenced as if it were stopped on the discharging belt of the discharging belt conveyor C2 but continuously moved in the discharging direction together with the sealer 7 and the movable table 2 while it is sealed by the sealer 7. Hence the article a is moved without stopping so that it is effectively packaged by the film. Inasmuch as the article a to be packaged is not influenced by inertia or shock caused by a temporary stop of the discharging conveyor belt C2 when the article a is sealed, the problem of collapse of the package and deviation of the packaging position will be substantially solved.

Welding and delivering operation of the film are not influenced by the successive feeding of the article a on the discharging belt since the sealer **7*a*, the film feeding unit 5 and the film opening unit 6 are moved together relative to the movable table 2 when the movable table 2** is reciprocatory moved.

Furthermore, inasmuch as the driven rollers 28, 30 of the belt conveyors C1, C2 are supported by the supporting members fixedly mounted on the movable table 2, an interval W between the belt conveyors C1, C2 is not changed but always constant whereby the article a is not hindered in its feeding.

Still furthermore, inasmuch as the drive rollers 14, 15 of the belt conveyors C1, C2 are supported by the supporting members fixedly mounted on the base 1 and the positions of the drive rollers 14, 15 are not varied, the article a can be carried on the feeding belt conveyor C1 and transferred to the discharging belt conveyor C2 with ease and can be fed to the heat tunnel without any obstacle.

Although the lengths L1, L2 of the belt conveyors C1, C2 are varied by the movement of the movable table 2, variations of the lengths L1 and L2 are absorbed by variation of M1, M2 of the intervals between the double winding rollers 20, 29 and the double winding rollers 21, 31 so that the belt conveyors C1, C2 are always kept tensioned.

When the articles are carried on the feeding belt, they are transferred to the discharging belt. At the same time the movable table is moved to the travelling direction of the discharging belt of the discharging belt conveyor. Inasmuch as the travelling speed of the discharging belt is substantially same as the moving speed of the movable table, the discharging belt travels as if it were stopped relative to the movable table. The article, the sealer and the movable table are travelling at the same speed in the same direction so that the articles can be sealed on the travelling discharging belt as if they were sealed on the stopped discharging belt. After the articles are sealed, they are still fed to the discharging direction and finally discharged from the discharging belt while the movable table is moved to the direction opposite to the travelling direction of the discharging belt and returned to the original position. When the movable table is moved the distance between the feeding belt and the discharging belt is not varied since the driven roller of the feeding belt conveyor and the discharging roller of the discharging belt conveyor are respectively supported by the supporting members fixedly mounted on the central portion of the movable table. Furthermore, the articles can be smoothly fed from the feeding belt to the discharging belt without any obstacle since the both belts are adjusted in the length thereof over the movable table by the movement of the second double winding rollers relative to the first double winding rollers and the both belts are tensioned.

With an arrangement and an operation of the packaging apparatus as described in detail above, the articles carried on the feeding belt conveyor are transferred to the discharging conveyor belt, sealed on and discharged from the discharging conveyor belt, and led to the heat tunnel without any obstacle. Inasmuch as the discharging belt conveyor does not stop while the articles are sealed to thereby eliminate the stopping time to be involved in sealing, increase remarkably a packaging capacity.

Furthermore, inasmuch as the articles are fed at a constant speed on the discharging belt, especially fed successively without stopping when they are sealed as if they were sealed on the stopped discharging belt, there is no likelihood that the articles are falled down or deviated in its position on the discharging belt due to inertia or shock caused by stopping or restarting of travelling of the discharging belt.

Although the invention has been described in its preferred form with a certain degree of particularity, it is to be understood that many variations and changes are possible in the invention without departing from the scope thereof.

What is claimed is:

1. A packaging apparatus for packaging articles in a double film comprising:

a. a base;

b. a movable table reciprocatory movable in the longitudinal direction thereof and composed of a base frame supported on the base, a feeding frame mounted on the rear portion of the base frame, and a sealing frame mounted on the front portion of the base frame;

c. a feeding belt conveyor comprising a drive roller supported by a supporting member fixed on the rear end of the base, a driven roller fixedly mounted on the front portion of the feeding frame, a first double winding roller supported by a supporting member fixedly mounted on the portion close to the rear end of the base, a second double winding roller mounted fixedly on the rear portion of the feeding frame, and a feeding belt trained and capable of travelling around the drive roller, the driven roller, the first double winding roller, and the second double winding roller for feeding the article carried thereon to the film;

d. a feeding unit disposed on the feeding frame and composed of a film feeding unit and a film opening unit;

the film feeding unit having a roll of film therein;

the film opening unit having an upper plate and a lower plate respectively formed in a triangle shape and an entrance for receiving the article therethrough formed obliquely with respect to the feeding belt conveyor so as to open in a direction opposite to the film feeding unit;

e. a sealing unit disposed on the sealing frame and composed of an L-shaped sealer and a supporting base pivotally connected to the L-shaped sealer, the sealing unit openably closing for welding the film containing the articles, and attaching the welded film; and f. a discharging belt conveyor comprising a drive roller supported by a supporting member fixed on the front end of the base, a driven roller fixedly mounted on the rear portion of the sealing frame, a first double winding roller supported by a supporting member fixedly mounted on the front portion of the base, a second double winding roller mounted fixedly on the front portion of the sealing frame, and a discharging belt trained and capable of travelling around the drive roller, the driven roller, the first double winding roller, and the second double winding roller for feeding the article to the sealing unit, and discharging the packaged articles from the discharging belt conveyor;

the driven roller of the discharging belt conveyor being spaced a predetermined interval from the driven roller of the feeding belt conveyor;

the travelling speed of the discharging belt being substantially the same as the moving speed of the movable table;

lengths of the feeding belt conveyor and the discharging belt conveyor being varied by the movement of the movable table and the variation of the lengths being absorbed by variations of intervals between the respective first and second double winding rollers.

2. A packaging apparatus for packaging articles in a double film according to claim 1, wherein the base has at the lower end portions thereof legs having movable wheels and retractable supporters for supporting the packaging apparatus.

3. A packaging apparatus for packaging articles in a double film according to claim 1, wherein the base has a pair of rails on the upper central portion thereof.

4. A packaging apparatus for packaging articles in a double film according to claim 3, wherein the base frame has at both ends thereof a pair of brackets fixedly mounted thereon, the brackets having sliding members fixed mounted thereon which are movable on the rails.

* * * * *